United States Patent [19]

Graybill et al.

[11] 4,370,209

[45] Jan. 25, 1983

[54] ELECTROLYTIC PROCESS INCLUDING RECOVERY AND CONDENSATION OF HIGH PRESSURE CHLORINE GAS

[75] Inventors: Wilmer B. Graybill; Malcolm Korach, both of Pittsburgh, Pa.

[73] Assignee: PPG Industries, Inc., Pittsburgh, Pa.

[21] Appl. No.: 233,427

[22] Filed: Feb. 11, 1981

Related U.S. Application Data

[63] Continuation-in-part of Ser. No. 14,466, Feb. 23, 1979, abandoned.

[51] Int. Cl.[3] ..... C25B 1/34

[52] U.S. Cl. ..... 204/98; 204/128

[58] Field of Search ..... 204/98, 128

[56] References Cited

U.S. PATENT DOCUMENTS 4,191,618 3/1980 Coker et al. ..... 204/98

FOREIGN PATENT DOCUMENTS 2729589 1/1978 Fed. Rep. of Germany ..... 204/98

905141 9/1962 United Kingdom ..... 204/258

*Primary Examiner*—R. L. Andrews

*Attorney, Agent, or Firm*—Richard M. Goldman

[57] ABSTRACT

Discloses the electrolysis of aqueous alkali metal halides while maintaining the anolyte compartment at an elevated pressure, whereby to recover chlorine therefrom at a superatmospheric partial pressure. The superatmospheric partial pressure chlorine gas is recovered from the cell and condensed.

13 Claims, No Drawings

ELECTROLYTIC PROCESS INCLUDING RECOVERY AND CONDENSATION OF HIGH PRESSURE CHLORINE GAS

CROSS REFERENCE TO RELATED APPLICATION

This is a continuation in part of our commonly assigned, copending U.S. application Ser. No. 14,466 filed Feb. 23, 1979 for SOLID POLYMER ELECTROLYTE CHLOR-ALKALI PROCESS AND ELECTROLYTIC CELL, now abandoned.

DESCRIPTION OF THE INVENTION

The compact chlor alkali electrolytic cells herein contemplated offer the advantages of high production per unit cell volume, high current efficiency, high current density, and the avoidance of gaseous anode products and the concomittant auxiliaries necessitated by gaseous products. According to the method of this invention, the bulk of the chlorine produced in a compact cell may be liquified by cooling alone. Compact electrolytic cells include zero gap electrolytic cells, solid polymer electrolyte electrolytic cells, and hybrid electrolytic cells.

Solid polymer electrolyte chlor alkali cells have a cation selective permionic membrane with an anodic electrocatalyst embedded in and on the anodic surface of the membrane, that is, in and on the anolyte facing surface of the permionic membrane, and a cathodic hydroxyl evolution catalyst, i.e., a cathodic electrocatalyst, embedded in and on the cathodic surface of the membrane, that is, the catholyte facing surface of the permionic membrane.

Zero gap electrolytic cells have a separator, e.g., a cation selective permionic membrane or an electrolyte permeable diaphragm, between an anode and a cathode. The anode and cathode removably and compressively bear upon the separator.

Hybrid electrolytic cells have a separator, e.g., a cation selective permionic membrane or an electrolyte permeable diaphragm, between an anode and a cathode, with one electrode removably and compressively bearing on the permionic membrane and the opposite electrode bonded to and embedded in the separator.

DETAILED DESCRIPTION OF THE INVENTION

As herein contemplated, the electrolytic cell is operated at an elevated pressure, whereby the chlorine is present in the anolyte compartment as an elevated pressure gas, and is removed therefrom as an elevated pressure gas. The elevated pressure chlorine gas may be removed from the cell as a gas or as a froth with anolyte liquor. Thereafter, the chlorine gas, still maintained at an elevated pressure, is condensed without further compression. That is, the elevated pressure chlorine gas is condensed by cooling alone without further compression.

By elevated pressure chlorine gas is meant chlorine gas at a partial pressure sufficiently high such that it can be cooled and condensed by readily available refrigerants and coolants, e.g., by water, requiring a chlorine gas partial pressure of above at least 38.8 pounds per square inch gauge, up to about 536 pounds per square inch gauge. Preferably the chlorine gas is maintained in the cell and associated piping at a partial pressure above about 80 or even 100 pounds per square inch gauge.

When the pressure of the chlorine gas is referred to herein, it is understood to mean the partial pressure of the chlorine gas, the total pressure in the system being higher.

The cathode side of the cell is advantageously maintained at an essentially equivalent elevated pressure to avoid damage to the ion permeable separator, i.e., the permionic membrane. The maximum allowable pressure difference between the anolyte and catholyte compartments is a function of electrode or current collector geometries, i.e., mesh size, thickness, and resiliency, and membrane thickness. The maximum allowable pressure difference should be below 25 pounds per square inch, and preferably below about 5 pounds per square inch or even 1 pound per square inch.

The high pressure method of operation herein contemplated is advantageously carried out in compact electrolytic cells. By compact electrolytic cells are meant electrolytic cells where the permionic membrane or diaphragm is structurally supported on both the anodic and cathodic side thereof. Suitable compact electrolytic cells include zero gap electrolytic cells, solid polymer electrolyte electrolytic cells, and hybrid cells.

By zero gap electrolytic cells are meant electrolytic cells where the electrodes removably contact the opposite surfaces of the permionic membrane or diaphragm, mechanically immobilizing the permionic membrane or diaphragm, and in some exemplifications avoiding the presence of electrolyte between the membrane or diaphragm and the electrocatalyst.

By solid polymer electrolyte electrolytic cells are meant electrolytic cells where the electrodes, or at least one set of electrodes, e.g., the anode or the cathode, is bonded to and embedded in the permionic membrane, and the permionic membrane electrode catalyst structure is held in place by the current distributors.

By hybrid cells are meant electrolytic cells where one electrode, e.g., the anode, is in zero gap configuration with the permionic membrane, and the other electrode, e.g., the cathode, is bonded to and embedded in the permionic membrane.

A solid polymer electrolyte chlor alkali cell has a solid polymer electrolyte with a permionic membrane therein. The permionic membrane has an anodic surface with chlorine catalyst thereon and a cathodic surface with cathodic hydroxyl evolution catalyst thereon. An external power supply is connected to the anodic catalyst by current distributor and connected to the cathodic catalyst by another current distributor. The current distributors also hold the permionic membrane in place, e.g., during pressure transients. In a zero gap electrolytic cell this function is performed by the electrode substrates, which carry electrocatalyst and bear upon the membrane.

Brine is fed to the anodic side of the solid polymer electrolyte where it contacts the anodic chlorine evolution catalyst on the anodic surface of the permionic membrane. The chlorine, present as chloride ion in the solution, forms chlorine according to the reaction:

$$2Cl^- \rightarrow Cl_2 + 2e^-$$

The alkali metal ion, that is, sodium ion or potassium ion, and its water of hydration, pass through the permionic membrane to the cathodic side of the permionic membrane. Water is fed to the catholyte compartment either externally, or as water of hydration passing through the permionic membrane or both. The stoichiometric reaction at the cathodic hydroxyl evolution catalyst is:

$$H_2O + e^- \rightarrow OH^- + \tfrac{1}{2}H_2$$

The permionic membrane should be chemically resistant and cation selective. The fluorocarbon resin permionic membrane is characterized by the presence of cation selective ion exchange groups, the ion exchange capacity of the membrane, the concentration of ion exchange groups in the membrane on the basis of water absorbed in the membrane, and the glass transition temperature of the membrane material.

The fluorocarbon resins herein contemplated have the moieties:

$$\left(CF_2-CXX'\right) \text{ and } \left(CF_2-\underset{\underset{Y}{|}}{C}-X\right)$$

where X is —F, —Cl, —H, or $-CF_3$; X' is —F, —Cl, —H, $-CF_3$ or $CF_3(CF_2)_m-$; m is an integer of 1 to 5; and Y is —A, —ϕ—A, —P—A, or $-O-(CF_2)_n$ (P, Q, R)—A.

In the unit (P, Q, R), P is $-(CF_2)_a(CXX')_b(CF_2)_c$, Q is $(-CF_2-O-CXX')_d$, R is $(-CXX'-O-CF_2)_e$, and (P, Q, R) contains one or more of P, Q, R.

ϕ is the phenylene group; n is 0 or 1; a, b, c, d and e are integers from 0 to 6.

The typical groups of Y have the structure with the acid group A connected to a carbon atom which is connected to a fluorine atom. These include $(CF_2)_xA$, and side chains having either linkages such as:

$$-O-(CF_2)_xA,$$

$$\left(-O-CF_2-\underset{\underset{Z}{|}}{CF}\right)_yA,$$

$$\left(O-CF_2-\underset{\underset{Z}{|}}{CF}\right)_x\left(O-CF_2-CF_2\right)_yA, \text{ and}$$

$$-O-CF_2\left(\underset{\underset{Z}{|}}{CF_2}-O-CF\right)_x\left(CF_2\right)_y\left(CF_2-O-\underset{\underset{R}{|}}{CF}\right)_zA,$$

where x, y, and z are respectively 1 to 10; Z and R are respectively —F or a $C_{1-10}$ perfluoroalkyl group, and A is the acid group as defined below.

In the case of copolymers having the olefinic and olefin-acid moieties above described, it is preferable to have 1 to 40 mole percent, and especially 3 to 20 mole percent of the olefin-acid moiety units in order to produce a membrane having an ion-exchange capacity within the desired range.

A is an acid group chosen from the group consisting of:

$-SO_3H$

—COOH $-PO_3H_2$, and $-PO_2H_2$, or a group which may be converted to one of the aforesaid groups by hydrolysis or by acidification.

In a particularly preferred exemplification of this invention, A may be either —COOH, or a functional group which can be converted to —COOH by hydrolysis or acidification such as —CN, —COF, —COCl, $-COOR_1$, —COOM, $-CONR_2R_3$: $R_1$ is a $C_{1-10}$ alkyl group, and $R_2$ and $R_3$ are either hydrogen or $C_1$ to $C_{10}$ alkyl groups, including perfluoroalkyl groups, or both. M is hydrogen, an alkali metal, an ammonium ion or a substituted ammonium ion; when M is an alkali metal it is most preferably sodium or potassium.

In an alternative exemplification, A may be either $-SO_3H$ or a functional group which can be converted to $-SO_3H$ by hydrolysis or acidification, or formed from $-SO_3H$ such as $-SO_3M'$, $(SO_2-NH)$ M'', $-SO_2NH-R_1-NH_2$, or $-SO_2NR_4R_5NR_4R_6$; M' is an alkali metal; M'' is H, $NH_4$ an alkali metal or an alkali earth metal; $R_4$ is H, Na or K; $R_5$ is a $C_3$ to $C_6$ alkyl group, $(R_1)_2NR_6$, or $R_1NR_6(R_2)_zNR_6$; $R_6$ is H, Na, K or $-SO_2$; and $R_1$ is a $C_2$–$C_6$ alkyl group.

The membrane material herein contemplated has an ion exchange capacity from about 0.5 to about 2.0 milligram equivalents per gram of dry polymer, and preferably from about 0.9 to about 1.8 milligram equivalents per gram of dry polymer, and in a particularly preferred exemplification, from about 1.1 to about 1.7 milligram equivalents per gram of dry polymer. When the ion exchange capacity is less than about 0.5 milligram equivalents per gram of dry polymer, the voltage is high, and the current efficiency is low at the high concentrations of alkaline metal hydroxide herein contemplated, while when the ion exchange capacity is greater than about 2.0 milligram equivalents per gram of dry polymer, the current efficiency of the membrane is too low.

The content of ion exchange groups per gram of absorbed water is from about 8 milligram equivalents per gram of absorbed water to about 30 milligram equivalents per gram of absorbed water and preferably from about 10 milligram equivalents per gram of absorbed water to about 28 milligram equivalents per gram of absorbed water, and in a preferred exemplification from about 14 milligram equivalents per gram of absorbed water to about 26 milligram equivalents per gram of absorbed water. When the content of ion exchange groups per unit weight of absorbed water is less than about 8 milligram equivalents per gram or above about 30 milligram equivalents per gram the current efficiency is too low.

The glass transition temperature is preferably at least about 20° C. below the temperature of the electrolyte. When the electrolyte temperature is between about 95° C. and 110° C., the glass transition temperature of the fluorocarbon resin permionic membrane material is below about 90° C. and in a particularly preferred exemplification below about 70° C. However, the glass transition temperature should be above about −80° C. in order to provide satisfactory tensile strength of the membrane material. Preferably the glass transition temperature is from about −80° C. to about 70° C. and in a particularly preferred exemplification, from about −80° to about 50° C.

When the glass transition temperature of the membrane is within about 20° C. of the electrolyte or higher than the temperature of the electrolyte, the resistance of the membrane increases and the perm selectivity of the membrane decreases. By glass transition temperature is meant the temperature below which the polymer segments are not energetic enough to either move past one another or with respect to one another by segmental Brownian motion. That is, below the glass transition temperature, the only reversible response of the polymer to stresses is strain while above the glass transition temperature the response of the polymer to stress is segmental rearrangement to relieve the externally applied stress.

The fluorocarbon resin permionic membrane materials contemplated herein have a water permeability of less than about 100 milliliters per hour per square meter at 60° C. in four normal sodium chloride at a pH of 10 and preferably lower than 10 milliliters per hour per square meter at 60° C. in four normal sodium chloride of the pH of 10. Water permeabilities higher than about 100 milliliters per hour per square meter, measured as described above, may result in an impure alkali metal hydroxide product.

The electrical resistance of the dry membrane should be from about 0.5 to about 10 ohms per square centimeter, and preferably from about 0.5 to about 7 ohms per square centimeter.

The thickness of the permionic membrane should be such as to provide a membrane that is strong enough to withstand pressure transients encountered during cell operation and manufacturing processes, e.g., the adhesion of the catalyst particles thereto, but thin enough to avoid high electrical resistivity. Preferably the membrane is from 50 to 1000 microns thick, and in a preferred exemplification, from about 100 to about 400 microns thick. Additionally, internal reinforcement, or increased thickness, or crosslinking may be utilized, or even lamination may be utilized whereby to provide a strong membrane. The membrane thickness required for adequate strength, i.e., to prevent rupture of the membrane by pressure excursions, is dependent upon the design of the structural members utilized on either side of the membrane to provide support. The combination of membrane thickness and structural support member design should be such that when the supported membrane is immersed in 4 normal sodium chloride at pH 2.5 to 4, at a temperature of 60 degrees Centigrade, it can withstand a pressure differential of at least 1 pound per square inch, and preferably about 5 pounds per square inch without rupturing. The structural support members, which may be electrodes, electrode supports, or current collectors, support the permionic membrane from both sides.

As herein contemplated, the anolyte compartment is maintained at an elevated pressure, i.e., a superatmospheric pressure, whereby to maintain the gaseous chlorine within the anolyte compartment at a superatmospheric partial pressure. The gaseous chlorine, containing a minor amount of by-product oxygen, is removed from the anolyte compartment at a partial pressure equal to or less than its partial pressure within the anolyte compartment, i.e., without further compression. The superatmospheric partial pressure gaseous chlorine may then be dried or partially dried, e.g., by passage through a demister, or the like.

Thereafter, the superatmospheric partial pressure gaseous chlorine, at a partial pressure equal to or less than its partial pressure within the anolyte compartment, i.e., without compression, is condensed whereby to yield liquid chlorine. The condensation may be carried out in a shell and tube heat exchanger condenser, e.g., with coolant or refrigerant on the shell side and the chlorine on the tube side. An evaporating liquid refrigerant, e.g., ammonia or a halogenated hydrocarbon, may be used to condense the chlorine. Alternatively, a coolant, e.g., water or chilled water, may be used to condense the chlorine.

The uncondensable oxygen together with a small amount of chlorine produced in the cell is passed to a secondary system for removal or recovery of the contained chlorine.

For example, chlorine gas containing about 2 percent oxygen is produced in an electrolytic cell operating at an electrolyte temperature of about 90 degrees Centigrade, and a pressure of about 200 pounds per square inch. The gas is condensed in a condenser at about 35 degrees Centigrade and about 200 pound per square inch gauge. The chlorine partial pressure in the condenser is about 130 pounds per square inch, and the oxygen partial pressure is about 70 pounds per square inch. The non-condensed gas is about 65 percent chlorine and about 35 percent oxygen. Approximately 96 percent of the chlorine is recovered in the first condenser. The non-condensed gas mixture may be bubbled through an alkaline solution, another absorbing liquid, or further condensed.

According to an alternative mode of operation, chlorine gas containing about 2 mole percent oxygen is produced at an electrolyte temperature of about 90 degrees Centigrade and a pressure of about 100 pounds per square inch gauge. The gas is condensed in a condenser at about 5 degrees Centigrade and about 100 pounds per square inch gauge. The chlorine partial pressure in the condenser is about 47.8 pounds per square inch, and the oxygen partial pressure is 52.2 pounds per square inch. The non-condensed gas is about 52.2 percent oxygen and about 47.8 percent chlorine. Approximately 98 percent of the chlorine is recovered in the first condenser.

The liquid chlorine may be super-cooled, for example, to allow venting of oxygen, nitrogen, carbon dioxide or the like, without substantial evaporation of liquid chlorine.

The cell pressure should be high enough so that when chlorine is recovered from the pressurized cell herein contemplated, cooling with water or chilled water alone is all that is required to liquify the chlorine. Preferably the partial pressure of chlorine in the cell is high enough to allow chilled water to be utilized as a coolant to liquefy at least 95 percent of the chlorine, i.e., above about 100 pounds per square inch gauge. In a particularly preferred exemplification, the partial pressure of chlorine is high enough to allow process water to be used as coolant to liquefy 90 percent or more of the chlorine, i.e., the partial pressure is above about 200 pounds per square inch gauge. (The pressure-temperature data of liquid chlorine is reproduced in Table I.)

TABLE I

VAPOR PRESSURE OF LIQUID CHLORINE

| Temperature °C. | Temperature °F. | Gage Pressure, Pounds per Square Inch |
|---|---|---|
| −30 | −22 | 3.1 |
| −25 | −13 | 7.2 |
| −20 | −4 | 13.4 |
| −15 | +5 | 17.2 |
| −10 | 14 | 23.5 |
| −5 | 23 | 30.6 |
| 0 | 32 | 38.8 |

TABLE I-continued

| VAPOR PRESSURE OF LIQUID CHLORINE | | |
|---|---|---|
| Temperature | | Gage Pressure, Pounds per Square Inch |
| °C. | °F. | |
| +5 | 41 | 47.8 |
| 10 | 50 | 58.2 |
| 15 | 59 | 68.9 |
| 20 | 68 | 81.9 |
| 25 | 77 | 95.4 |
| 30 | 86 | 111.7 |
| 35 | 95 | 129.9 |
| 40 | 104 | 149.0 |
| 45 | 113 | 170.8 |
| 50 | 122 | 193.1 |
| 55 | 131 | 218.1 |
| 60 | 140 | 243.8 |
| 65 | 149 | 271.0 |
| 70 | 158 | 302.4 |
| 75 | 167 | 335.7 |
| 80 | 176 | 370.9 |
| 85 | 185 | 409.1 |
| 90 | 194 | 448.8 |
| 95 | 203 | 492.2 |
| 100 | 212 | 536 |
| 105 | 221 | 586 |
| 110 | 230 | 638 |
| 115 | 239 | 694 |
| 120 | 248 | 756 |
| 125 | 257 | 822 |
| 130 | 266 | 888 |
| 135 | 275 | 960 |
| 140 | 284 | 1035 |
| — | — | — |

When the electrolyzer is operated to ultimately recover liquid chlorine, the pressure should be high enough to avoid the use of compressors prior to liquifaction.

The system pressure, i.e., the pressure in the electrolyzer and in the condenser, should be high enough to allow gaseous nitrogen and oxygen to be vented from the system, e.g., after chlorine condensation, without evaporating significant amounts of liquid chlorine.

When operating to produce liquid chlorine directly from the electrolytic cell, the temperature of the cell should be below about 100° C., whereby to maintain the design pressure on the electrolyzer below about 600 pounds per square inch gauge, corresponding to about 90 mole percent chlorine in the cell gas at a chlorine partial pressure of 536 pounds per square inch. Preferably, the temperature of the cell should be below about 50° C., whereby to allow design pressure of the cell to be below about 225 pounds per square inch, corresponding to about 85 mole percent chlorine in the cell gas at a chlorine partial pressure of 193 pounds per square inch. The gas vented from the cell to remove inerts is preferably cooled with process water or chilled water to recover the bulk of the contained chlorine as liquid chlorine.

Especially preferred are operating conditions of temperature and pressure which result in gaseous chlorine being withdrawn from the electrolytic cell and passed to a condenser system in which cooling is effected with process water, i.e., water at from about 20 to 40 degrees Centigrade, resulting in liquifaction of more than about 95 percent of the contained chlorine. The remainder of the chlorine may be recovered in a secondary recovery system, from which the residual chlorine gas as well as the non-condensables are passed to a final chlorine removal or neutralization system. This can be accomplished by operating the electrolytic cell at about 90 degrees Centigrade and about 200 pounds per square inch gauge, while cooling the gaseous chlorine product to about 35 degrees Centigrade and maintaining the production of inerts, i.e., non-condensable gases, such as oxygen, below about 2 mole percent of the gaseous anode products.

However, the desired temperature and pressure of the cell may depend upon the end use of the liquid chlorine and the required vapor pressure and temperature of the liquid chlorine. As a practical matter, the pressure within the cell is also dependent upon the pressure of the auxiliaries and end use of the chlorine as well as the structural components of the cell.

High pressure is particularly advantageous, on the catholyte side of the individual electrolytic cell in cases where the cathodic reaction is depolarized with a gaseous reactant as the high pressure serves to increase the depolarization reaction rate and improve depolarization reaction efficiency. For example, a gaseous oxidant may be fed to the catholyte compartment at a superatmospheric pressure, e.g., within about 5 pounds per square inch gauge of the pressure in the anolyte compartment, to enhance the depolarization reaction rate and efficiency. Preferably the pressure of the catholyte compartment is higher than the superatmospheric pressure of the anolyte compartment whereby to avoid leakage of chlorine into the catholyte compartment, e.g., in the event of membrane damage.

The catholyte liquor recovered from the cell typically will contain in excess of 20 weight percent alkali metal hydroxide. Where, as in a preferred exemplification, the permionic membrane is a carboxylic acid membrane, as described hereinabove, the catholyte liquor may contain in excess of 30 to 35 percent, for example, 40 or even 45 or more weight percent alkali metal hydroxide.

The anolyte liquor recovered from the cell will be saturated with chlorine at the cell operating temperature and pressure. The gaseous chlorine liberated from the anolyte liquor may be recovered in the secondary chlorine recovery system, or removed from the anolyte liquor during the salt resaturation and purification process.

The current density of the solid polymer electrolyte electrolytic cell 11 may be higher than that in a conventional permionic membrane or diaphragm cell, for example, in excess of 200 amperes per square foot, and preferably in excess of 400 amperes per square foot. According to one preferred exemplification of this invention, electrolysis may be carried out at a current density of 800 or even 1,200 amperes per square foot, where the current density is defined as total current passing through the cell divided by the surface area of one side of the permionic membrane 33.

While the method of this invention has been described with reference to specific exemplifications, embodiments, and examples, the scope is not to be limited except as limited by the claims appended hereto.

We claim:

1. In a method of electrolyzing an aqueous alkali metal chloride brine in an electrolytic cell having an anolyte compartment with an anode therein, a catholyte compartment with a cathode therein, and a permionic membrane separator therebetween, comprising feeding the brine to the anolyte compartment, passing an electrical current from the anode to the cathode, and recovering chlorine from the anolyte compartment, the improvement comprising:

a. supporting the permionic membrane by maintaining the anode in contact therewith on one side thereof and maintaining the cathode in contact therewith on the opposite side thereof whereby to enable the permionic membrane to withstand a pressure differential of at least 1 pound per square inch;

b. maintaining a superatmospheric pressure in the anolyte compartment, whereby to maintain the chlorine at a superatmospheric partial pressure above 200 pounds per square inch gauge;

c. withdrawing gaseous chlorine from the anolyte compartment at a superatmospheric partial pressure; and d. cooling, without compression, the superatmospheric pressure gaseous chlorine below the boiling temperature corresponding to the partial pressure thereof, whereby to condense chlorine.

2. The method of claim 1 wherein the anode and cathode removably and compressively bear on the ion permeable separator.

3. The method of claim 1 wherein one of the electrodes is bonded to and embedded in the ion permeable separator.

4. The method of claim 3 wherein both of the electrodes are bonded to and embedded in the ion permeable separator.

5. The method of claim 3 wherein the opposite electrode removably and compressively bears upon the ion permeable separator.

6. The method of claim 1 comprising withdrawing the superatmospheric partial pressure gaseous chlorine from the anolyte compartment of the electrolytic cell, separating water vapor therefrom, and thereafter transferring the superatmospheric partial pressure gaseous chlorine directly to a condensor whereby to obtain liquid chlorine.

7. The method of claim 1 wherein a superatmospheric pressure is maintained in the catholyte compartment.

8. The method of claim 7 wherein the superatmospheric pressure in the catholyte compartment is within 5 pounds per square inch of the superatmospheric pressure in the anolyte compartment.

9. The method of claim 1 comprising depolarizing the cathodic reaction.

10. The method of claim 9 comprising feeding a gaseous oxidant to the catholyte compartment at a superatmospheric pressure.

11. The method of claim 10 comprising feeding the gaseous oxidant to the catholyte compartment at a superatmospheric pressure greater than the superatmospheric pressure within the anolyte compartment.

12. The method of claim 1 comprising recovering gaseous and liquid chlorine from the anolyte compartment.

13. In a method of electrolyzing an aqueous alkali metal chloride brine in an electrolytic cell having a anolyte compartment with an anode therein, a catholyte compartment with a cathode therein, and a permionic membrane separator therebetween, comprising feeding the brine to the anolyte compartment, passing an electrical current from the anode to the cathode, and recovering chlorine from the anolyte compartment, the improvement comprising:

a. supporting the permionic membrane by maintaining the anode in contact therewith on one side thereof and maintaining the cathode in contact therewith on the opposite side thereof whereby to enable the permionic membrane to withstand a pressure differential of at least 1 pound per square inch;

b. maintaining a superatmospheric pressure in the anolyte compartment, whereby to maintain the chlorine at a superatmospheric partial pressure above 200 pounds per square inch gauge;

c. withdrawing gaseous chlorine from the anolyte compartment at a superatmospheric partial pressure;

d. cooling, without compression, the superatmospheric pressure gaseous chlorine below the boiling temperature corresponding to the partial pressure thereof, whereby to condense chlorine; and e. feeding an oxidant to the cathode whereby to depolarize the cathode and substantially avoid formation of hydrogen gas.

* * * * *